US008154372B2

(12) United States Patent
Feng et al.

(10) Patent No.: US 8,154,372 B2
(45) Date of Patent: Apr. 10, 2012

(54) LIGHT-WEIGHT, CONDUCTION-COOLED INDUCTOR

(75) Inventors: Frank Z. Feng, Loves Park, IL (US); Steven Schwitters, Rockford, IL (US); Clifford G. Thiel, Lanark, IL (US); Debabrata Pal, Hoffman Estates, IL (US); John Horowy, Rockford, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 185 days.

(21) Appl. No.: 11/999,614

(22) Filed: Dec. 6, 2007

(65) Prior Publication Data

US 2009/0146769 A1 Jun. 11, 2009

(51) Int. Cl.
*H01F 27/02* (2006.01)
*H01F 27/28* (2006.01)

(52) U.S. Cl. ..... 336/90; 336/92; 336/225; 336/229

(58) Field of Classification Search ..... 336/90, 336/92, 225, 229
See application file for complete search history.

(56) References Cited

U.S. PATENT DOCUMENTS

| | | | | | |
|---|---|---|---|---|---|
| 2,389,638 | A | * | 11/1945 | Ruben | 315/211 |
| 3,465,273 | A | * | 9/1969 | Brock | 336/62 |
| 4,459,576 | A | * | 7/1984 | Fox et al. | 336/84 C |
| 5,165,162 | A | * | 11/1992 | Charles | 29/605 |
| 5,211,767 | A | * | 5/1993 | Shigeta et al. | 148/121 |
| 5,214,403 | A | * | 5/1993 | Bogaerts et al. | 336/84 C |
| 5,789,828 | A | * | 8/1998 | Tremaine et al. | 307/64 |
| 6,419,760 | B1 | * | 7/2002 | Takemoto et al. | 148/306 |
| 6,492,893 | B2 | * | 12/2002 | De Graaf | 336/229 |
| 2007/0080769 | A1 | | 4/2007 | Thiel et al. | |

FOREIGN PATENT DOCUMENTS

| | | | | |
|---|---|---|---|---|
| DE | 3522740 | A1 | * | 10/1986 |
| JP | 02198116 | A | * | 8/1990 |

* cited by examiner

*Primary Examiner* — Elvin G Enad
*Assistant Examiner* — Tsz Chan
(74) *Attorney, Agent, or Firm* — Kinney & Lange, P.A.

(57) ABSTRACT

A lightweight inductor for the motor controller of an aircraft starter includes a toroidal inductor core divided into multiple sections that are separated by a thermally conductive, but electrically insulating, material. The inductor core is wound with wire and positioned inside of an electrically and thermally conductive container, which acts as a heat sink and EMI shield, while also reducing eddy currents within the inductor core.

22 Claims, 4 Drawing Sheets

LIGHT-WEIGHT, CONDUCTION-COOLED INDUCTOR

BACKGROUND

The invention relates generally to inductors. More specifically, the invention relates to a light-weight inductor used in power filters for multi-function motor controllers in aircraft engines.

When starting a traditional aircraft engine, the engine's shaft is rotated to operating speed by a pneumatic starter. Sparks are subsequently delivered to ignite a fuel/air mixture, which then powers the aircraft engine. This pneumatic starter, however, uses heavy components, which reduces the efficiency of the aircraft.

More recently-designed aircraft replace the pneumatic starter with an electric motor mounted on the shaft of the aircraft engine and a motor controller mounted inside the fuselage of the aircraft. Power is delivered to the electric motor from the motor controller by electric cables, and the electric motor rotates the aircraft engine's shaft up to operating speed. After the engine starting process is completed, the same motor controller is used to operate other motors, such as motors powering the Cabin Air Compressor (CAC) and the landing gear. This multi-function motor controller is called the "common motor starter controller" (CMSC). Included in the CMSC are three identical differential mode inductors. Up to 800 amperes (amps) at 0 hertz (Hz) is conducted through these inductors during the engine starting process, and up to 350 amps at 1450 Hz is conducted through these inductors during other motor applications.

Therefore, there is a need in the art for a differential mode inductor for use in a common motor starter controller that minimizes power loss and maximizes the extraction of heat generated by power loss, thereby keeping operating temperature below required limits. The inductor should also generate less heat than conventional inductors and be able to dissipate the heat that is generated over the high current range in which the inductor must function. Also, the inductor should be light in weight, since weight is often a significant factor in aerospace systems.

SUMMARY OF THE INVENTION

The invention is an inductor with a toroidal core divided into multiple segments, which are separated by electrically insulating material. The inductor is encapsulated in an electrically insulating, but thermally conductive, potting compound, and is housed inside an electrically and thermally conducting can. The inductor is lightweight, works over a broad range of frequencies with low power loss, generates less heat than conventional inductors, and effectively dissipates the heat that is generated.

DETAILED DESCRIPTION

Figure 1:
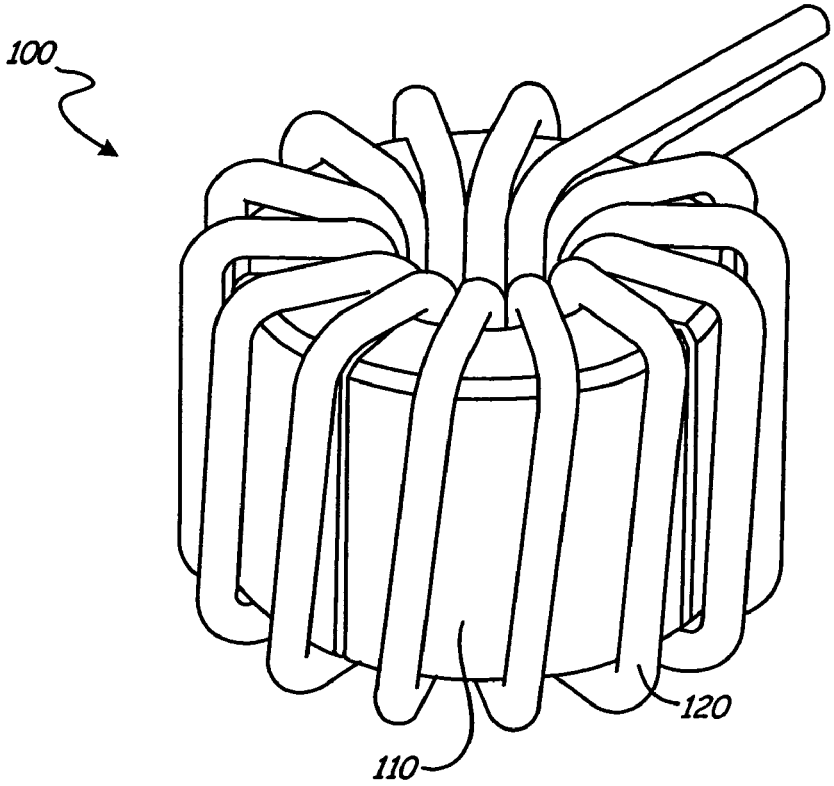
FIG. 1 shows a wound inductor core of an embodiment of the invention.

FIG. 1 shows the wound inductor core of an embodiment of the invention. Inductor 100 includes inductor core 110 wrapped with wire 120. Inductor core 110 is in the shape of a toroid, and wire 120 is wound through the hole in the center of inductor core 110 and around the outside surface of inductor core 110. Wire 120 is shown with 11 turns around inductor core 110, but those skilled in the art will recognize that any number of turns could be used to create inductor 100. In one embodiment of the invention, wire 120 is two parallel AWG6 5-bundle Litz wires connected at ends of the winding. This wire is a finely stranded wire in which every strand is insulated with a thin enamel to prevent conduction between wires. AWG6 5-bundle Litz wire exhibits smaller eddy current loss than other wires at higher frequencies, particularly those exceeding 10 kilohertz (kHz).

Figure 2:
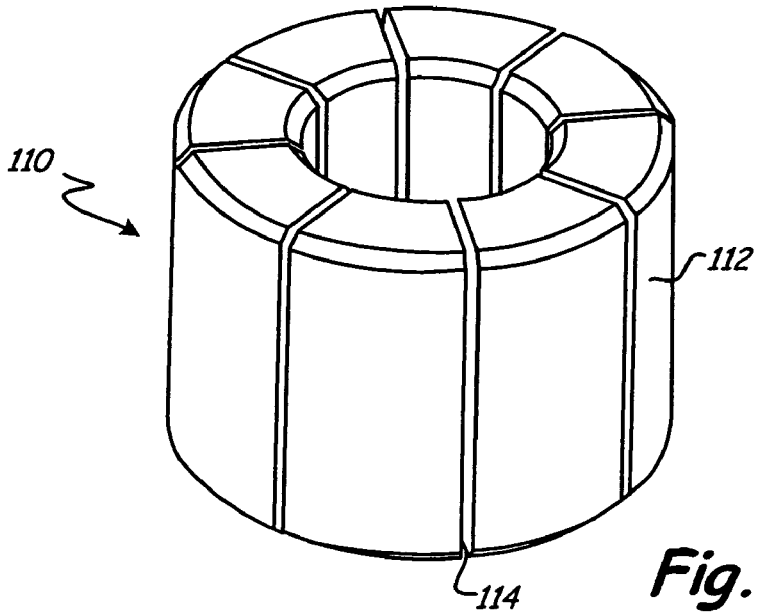
FIG. 2 shows the inductor core shown in FIG. 1, but without any winding.

FIG. 2 shows inductor core 110 without wire 120. Inductor core 110 is made of eight arcuate inductor core sections 112. Each of the eight inductor core sections 112 is separated by a gap 114. Although FIG. 2 shows inductor core 110 with 8 sections 112 and 8 gaps 114, one skilled in the art will recognize that any number of sections and gaps may be used and still fall within the scope of the invention. Inductor core 110 is made of a magnetic material. In one embodiment, inductor core 110 is made of with a thin tape with high permeability, such as 25 micron Metglas® 2605-SA1 magnetic alloy tape. The tape is wrapped to form a toroid and impregnated with an epoxy. The resulting toroid is then cut into 8 pieces, creating inductor core sections 112 and gaps 114. Ideally, gaps 114 should be filled with a material that is both an electrical insulator and a thermal conductor. In one embodiment, gaps 114 are filled with a glass-epoxy laminate, such as G11, held in place inside gap 114 with a die-attach adhesive, such as Abelbond® adhesive. In another embodiment, a material with a higher thermal conductivity, such as aluminum nitride, is used to fill gaps 114.

In one embodiment of the invention, inductor core 110 has an outside diameter of about 104 millimeters, an inner diameter of about 52 millimeters and a height of about 76 millimeters. In that same embodiment, gaps 114 are about 1.25 millimeters wide.

In inductors energized with alternating current, the alternating magnetic fields produced by the alternating current tend to induce eddy currents within the inductor core. These electric currents in the inductor core must overcome the electrical resistance offered by the core, and eddy currents thus generate heat. The effect is more pronounced at high frequencies, such as those high frequencies found in electric starter controllers in aircraft. Small, multiple gaps 114, as well as the toroidal shape of inductor core 110, reduce the extent of eddy currents in inductor core 110, and thus reduce the amount of heat generated by inductor 100.

Figure 3:
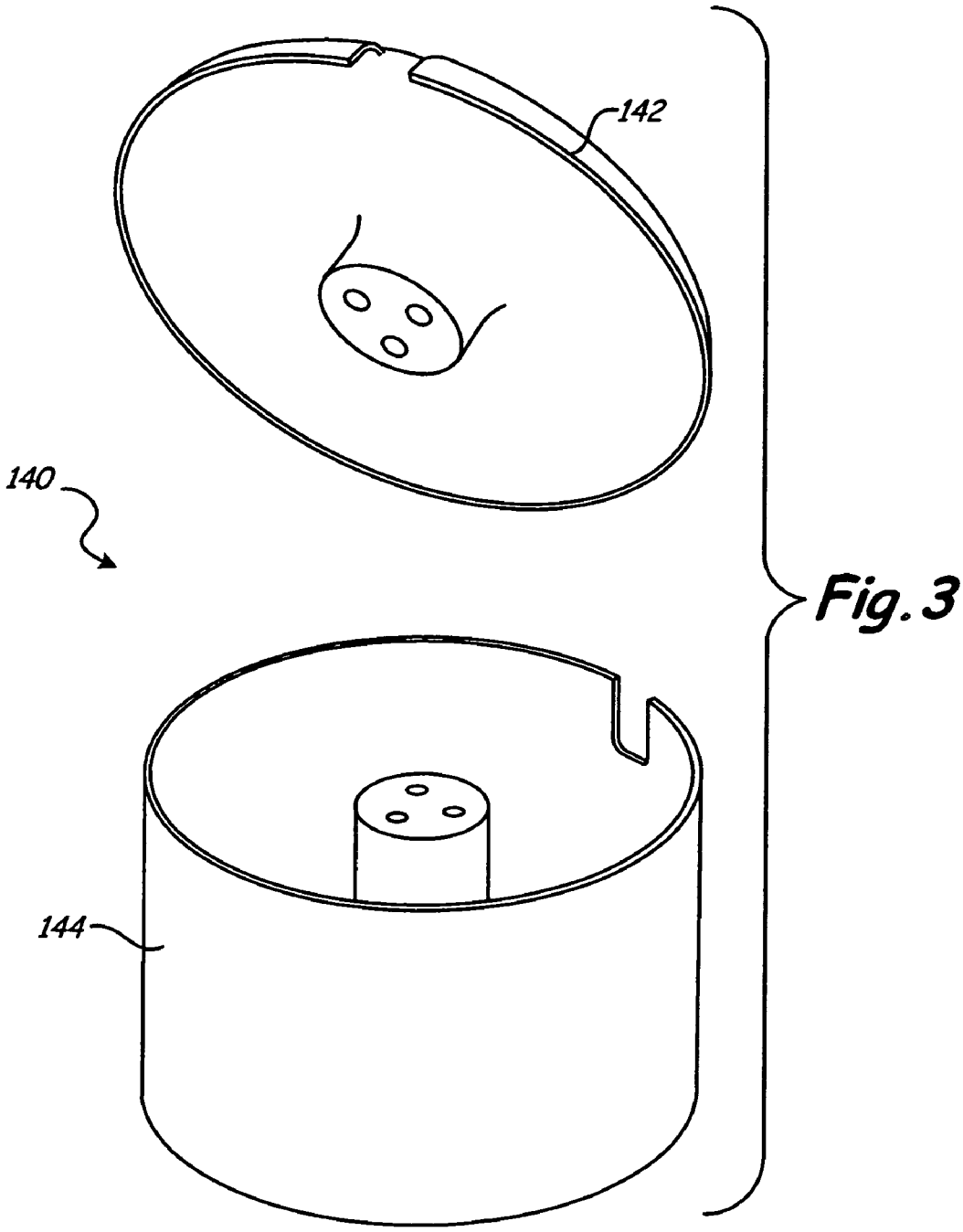
FIG. 3 shows the container in which the inductor is placed.

FIG. 3 shows can 140, which include top 142 and bottom 144. Inductor 100 fits inside can 140, which performs three functions. First, can 140 shields inductor 100 from external electromagnetic interference (EMI). Second, can 140 acts as a heat sink for heat generated by inductor 100, conducting much of the heat generated by inductor 100 to can 140. Finally, can 140 reduces eddy currents in inductor core 110. Can 140 acts as a low resistance path to encourage eddy current flow within can 140 induced by stray magnetic fields from gaps 114. The eddy currents within can 140 produce magnetic flux which counters stray magnetic flux due to gaps 114, thus reducing eddy currents in inductor core 110 and thereby further reducing core loss in inductor 100.

Can 140 is made of a material that has a high thermal and electrical conductivity, such as aluminum. The wound inductor 100 is encapsulated in a thermally conductive, but electrically insulating, potting compound, such as Stycast® 5954. The encapsulated inductor 100 is housed inside of can 140. Can 140 typically exhibits about 25 times the thermal conductivity of inductor core 110, and is thus able to dissipate much of the heat generated by inductor 100. Can 140 is typically mounted to a cold plate (not shown) to facilitate heat dissipation. In one embodiment of the invention, the bottom surface of can 140 is flat, in order to maximize heat dissipation between the bottom of can 140 and the cold plate. Also, a flat-bottomed can allows this inductor to be used with a liquid-cooled cold plate.

Figure 4:
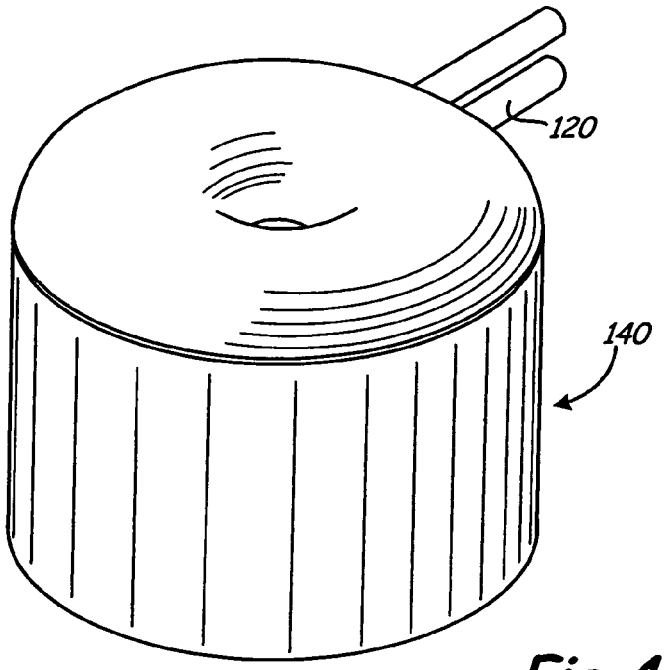
FIG. 4 shows an embodiment of the invention when fully assembled.

FIG. 4 shows the fully assembled invention in which inductor 100 (not shown in FIG. 4) is inside of metal can 140, with top 142 and bottom 144 in their assembled positions.

Figure 5A:
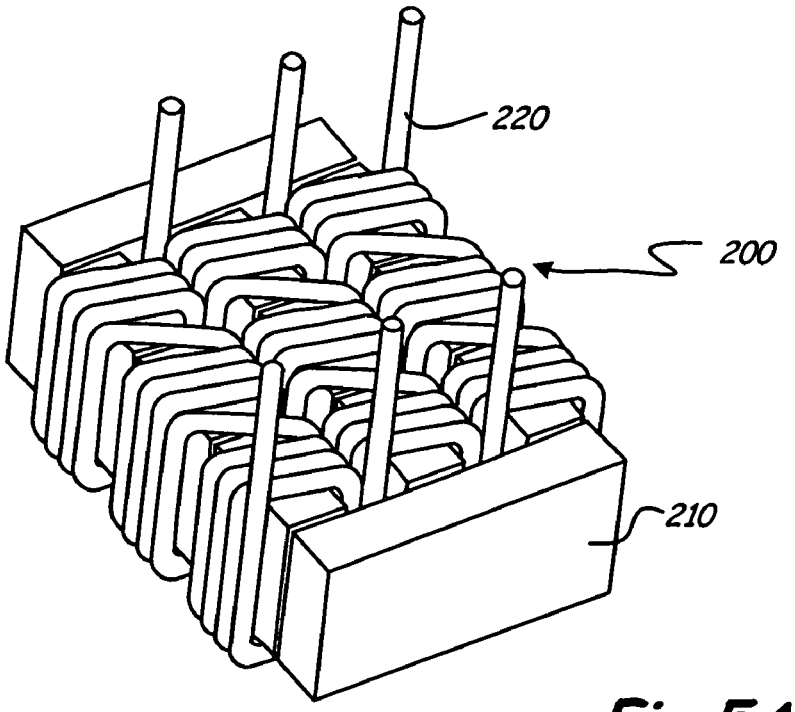
Fig. 5A (PRIOR ART)
FIGS. 5A and 5B show a prior art inductor.
Figure 5B:
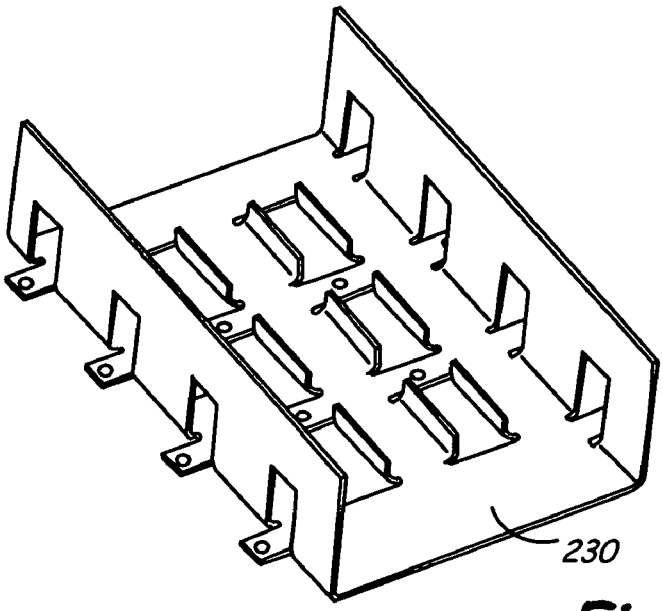
Fig. 5B (PRIOR ART)

FIG. 5A and FIG. 5B show a prior art inductor. In FIG. 5A, inductor 200 includes rectangular inductor core 210 and wire 220. Prior art inductor 200 fits inside heat sink 230, which is shown in FIG. 5B. Prior art inductor 200 generates a magnetic flux that impinges on heat sink 230, generating an electrical eddy current that runs through heat sink 230, generating substantial heat. Thus, in the prior art, heat sink 230 actually generates heat in addition to acting as a heat sink for inductor 200. In contrast, in the present invention, there is no magnetic flux impinging on can 140, so the heat generated by can 140, which also acts as a heat sink in the present invention, is nearly zero.

Figure 6:
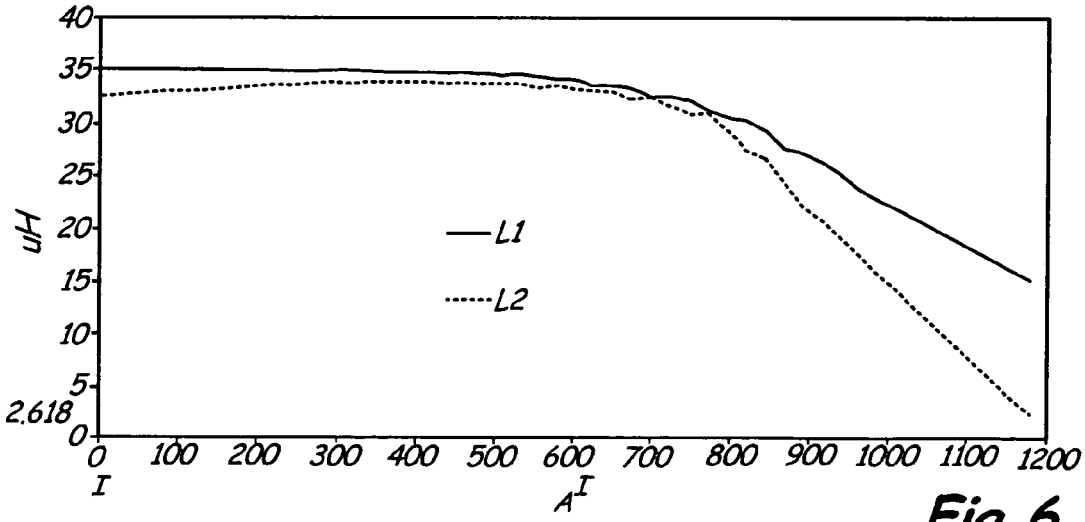
FIG. 6 is a graph showing the inductance in relation to current of an embodiment of the invention compared to a prior art inductor.

FIG. 6 is a graph comparing the inductor of the present invention with the prior art inductor shown in FIG. 5. In FIG. 6, the x-axis represents current in amps (A) and the y-axis represents inductance in microhenries (μH). The curve identified as L1 in FIG. 6 shows the inductance over a range of current of an embodiment of the invention, while the curve L2 shows the inductance of a prior art inductor over the same range of current.

In order for the motor controller of an aircraft to function properly, the inductor must maintain high inductance at a high current. Ideally, as current rises from 0 to 400 amps, the inductance should be constant. The graph of FIG. 6 shows that the present invention (curve L1 in FIG. 6) produces greater inductance over the desired current range than a prior art inductor (curve L2 in FIG. 6) and also produces stable inductance as the current rises from 0 to 400 amps.

The present invention is a lightweight inductor assembly that may be used in the motor controller of an aircraft starter. The wound inductor core is positioned inside of a thermally conductive, but electrically insulating, container, which acts as a heat sink and EMI shield, while also reducing eddy currents within the inductor core. The aircraft starter is able to function with multiple applications, yet still dissipate the heat of the inductor. The present invention performs better than prior art inductors, while also demonstrating less power loss and greater heat dissipation than prior art inductors. The invention also performs well in extreme conditions. For example, in high current conditions, such as those found when starting an aircraft engine, the gaps in the inductor core prevent the inductor core from becoming saturated. In high frequency conditions, losses due to eddy currents are minimized by the toroidal shape of the inductor core and the use of a can around the inductor.

Although the present invention has been described with reference to preferred embodiments, workers skilled in the art will recognize that changes may be made in form and detail without departing from the spirit and scope of the invention.

The invention claimed is:

1. An inductor assembly comprising:

a toroidal magnetic inductor core divided into a plurality of arcuate sections;

an electrically insulating material filling a plurality of discrete gaps between each of the arcuate sections;

wiring wrapped around the magnetic inductor core; and a two-part electrically and thermally conducting container having a toroidal shape generally corresponding to the wire-wrapped toroidal inductor core, the container entirely surrounding the wire-wrapped toroidal inductor core on a top, a bottom, an inside diameter, and an outside diameter of the core and defining a continuous electrically and thermally conductive path between an upper part and a lower part of the container adjacent at least one of the inside diameter and the outside diameter;

wherein the container shields the wire-wrapped core from external electromagnetic interference, acts as a heat sink for heat generated by the inductor assembly, and reduces core losses by preferentially encouraging eddy current flow within the container relative to the wire-wrapped core, the continuous electrically and thermally conducting path surrounding the wire-wrapped core providing a low resistance path for eddy current flow, the eddy current flow within the container producing magnetic flux to counter stray magnetic flux around the inductor core caused by the plurality of gaps.

2. The inductor assembly of claim 1 wherein the wiring comprises Litz wire.

3. The inductor assembly of claim 1 wherein the inductor core comprises magnetic alloy tape impregnated with epoxy.

4. The inductor assembly of claim 1 wherein the electrically insulating material filling the plurality of gaps is either G11 glass-epoxy laminate or aluminum nitride.

5. The inductor assembly of claim 1 wherein the electrically and thermally conducting container comprises aluminum.

6. The inductor assembly of claim 1, wherein a height of the core is about 76 mm, a width of each electrically insulating section is about 1.25 mm, the inside diameter of the core is about 52 mm, and the outside diameter is about 104 mm.

7. The inductor assembly of claim 1, wherein the container includes at least one substantially flat outer surface for dissipating heat to an adjacent cooling structure.

8. The inductor assembly of claim 1, wherein a width of each gap is at least 4.0% of an average linear dimension across a face of each corresponding arcuate segment for producing stable inductance through a first current range.

9. The inductor assembly of claim 8, wherein the inductor assembly produces stable inductance in the first current range between about 0 amperes and about 400 amperes.

10. An inductor assembly comprising:

a toroidal magnetic inductor core, the core comprising a plurality of discrete sections alternating between an arcuate magnetic section and an electrically insulating section, wherein each electrically insulating section is formed from either G11 glass-epoxy laminate or aluminum nitride;

wiring wrapped around the toroidal inductor core; and a two-part electrically and thermally conducting container having a toroidal shape generally corresponding to the wire-wrapped toroidal inductor core, the container entirely surrounding the wire-wrapped core on a top, a bottom, an inside diameter, and an outside diameter of the core;

wherein the container defines a continuous electrically and thermally conductive path between an upper part and a lower part of the container adjacent at least one of the inside diameter and the outside diameter; and wherein the container shields the wire-wrapped core from external electromagnetic interference, acts as a heat sink for heat generated by the inductor assembly, and reduces core losses by preferentially encouraging eddy current flow within the container relative to the wire-wrapped core, the continuous electrically and thermally conducting path surrounding the wire-wrapped core providing a low resistance path for eddy current flow, the eddy current flow within the container producing magnetic flux to counter stray magnetic flux around the inductor core caused by the plurality of gaps.

11. The inductor assembly of claim 10 wherein the wiring comprises Litz wire.

12. The inductor assembly of claim 10 wherein the inductor core comprises magnetic alloy tape impregnated with epoxy.

13. The inductor assembly of claim 10 wherein the container comprises aluminum.

14. The inductor assembly of claim 10, wherein a height of the core is about 76 mm, a width of each electrically insulating section is about 1.25 mm, an inside diameter of the core is about 52 mm, and an outside diameter of the core is about 104 mm.

15. The inductor assembly'of claim 10, wherein the container includes at least one substantially flat outer surface for dissipating heat to an adjacent cooling structure.

16. The inductor assembly of claim 10, wherein a width of each gap is at least 4.0% of an average linear dimension across a face of each corresponding segment for producing stable inductance through a first current range.

17. The inductor assembly of claim 16, wherein the inductor assembly produces stable inductance in the first current range between about 0 amperes and about 400 amperes.

18. A common motor/starter controller (CMSC) for a gas turbine engine, the controller comprising:

controller circuitry; and a differential mode inductor assembly including a wire-wrapped gapped toroidal magnetic inductor core potted within a two-part electrically and thermally conducting container having a toroidal shape generally corresponding to the wire-wrapped toroidal core, the core having a plurality of arcuate magnetic segments separated by a corresponding plurality of electrically insulating gap fillers adhesively secured to and entirely covering inner surfaces of each adjacent magnetic segment, and the container entirely surrounding the wire-wrapped core on a top, a bottom, an inside diameter, and an outside diameter of the core, the container defining a continuous electrically and thermally conducting path between an upper part and a lower part of the container adjacent at least one of the inside diameter and the outside diameter;

wherein the CMSC is operable between an engine starting mode characterized by low frequency operation of the inductor assembly and a non-starting mode characterized by high frequency operation of the inductor assembly, the inductor assembly generating substantially stable inductance in the engine starting mode and the inductor assembly minimizing core losses in a non-starting mode via the continuous electrically and thermally conducting path formed by the container providing a low resistance path for eddy current flow within the container producing magnetic flux to counter stray magnetic flux around the inductor core caused by the plurality of gaps.

19. The CMSC of claim 18, further comprising a plurality of differential mode inductor assemblies.

20. The CMSC of claim 18, wherein the core has an outer diameter of at least about 100 mm and a height of at least about 70% of the outer diameter.

21. The CMSC of claim 18, wherein a width of each gap is at least 4.0% of an average linear dimension across a face of each corresponding arcuate magnetic segment for achieving stable inductance up to about 400 amperes of current.

22. The CMSC of claim 18, wherein the two-part container is a can having an upper metal lid and a lower metal can, each of the parts having an E-shaped cross-section.

* * * * *

UNITED STATES PATENT AND TRADEMARK OFFICE

CERTIFICATE OF CORRECTION

PATENT NO. : 8,154,372 B2
APPLICATION NO. : 11/999614
DATED : April 10, 2012
INVENTOR(S) : Frank Z. Feng et al.

It is certified that error appears in the above-identified patent and that said Letters Patent is hereby corrected as shown below:

Col. 5, Line 26
Delete “” after assembly

Signed and Sealed this
Thirty-first Day of July, 2012

David J. Kappos

David J. Kappos
*Director of the United States Patent and Trademark Office*